US008936287B2

(12) United States Patent
Stayton

(10) Patent No.: US 8,936,287 B2
(45) Date of Patent: Jan. 20, 2015

(54) TWEEZER DEVICE INCORPORATING IMPROVED GRIPPING TIP STRUCTURES, AND METHOD OF USING

(71) Applicant: Stephen Burton Stayton, Tucson, AZ (US)

(72) Inventor: Stephen Burton Stayton, Tucson, AZ (US)

( * ) Notice: Subject to any disclaimer, the term of this patent is extended or adjusted under 35 U.S.C. 154(b) by 0 days.

(21) Appl. No.: 13/924,692

(22) Filed: Jun. 24, 2013

(65) Prior Publication Data

US 2013/0341941 A1 Dec. 26, 2013

Related U.S. Application Data

(60) Provisional application No. 61/663,592, filed on Jun. 24, 2012.

(51) Int. Cl.
*B25B 9/00* (2006.01)
*B25B 9/02* (2006.01)

(52) U.S. Cl.
CPC ..... *B25B 9/02* (2013.01); *Y10S 294/902* (2013.01)
USPC ..... 294/99.2; 294/902

(58) Field of Classification Search
CPC ..... B25B 9/02; A47G 21/10; A47J 43/283; A61B 17/30; A61B 17/50; D06F 5/06; G04D 3/045; A44C 17/043
USPC ..... 294/99.2, 16, 8.5, 11, 902; 81/7, 8; 606/210
See application file for complete search history.

(56) References Cited

U.S. PATENT DOCUMENTS

| | | | | | |
|---|---|---|---|---|---|
| 1,083,786 | A * | 1/1914 | Young | 24/30.5 R |
| 1,607,204 | A * | 11/1926 | Linzmaier | 294/118 |
| 2,608,433 | A * | 8/1952 | Marbeuf | 294/99.2 |
| 2,653,048 | A * | 9/1953 | Novak | 294/99.2 |
| 2,887,110 | A * | 5/1959 | Roeschmann | 606/138 |
| 3,281,179 | A * | 10/1966 | Miller | 294/16 |
| 4,478,451 | A * | 10/1984 | Brucher et al. | 294/106 |
| 4,610,252 | A * | 9/1986 | Catalano | 606/157 |
| 7,216,910 | B2 * | 5/2007 | Frauscher | 294/99.2 |
| 8,608,217 | B1 * | 12/2013 | Meng | 294/99.2 |
| 2009/0134645 | A1 * | 5/2009 | Dong et al. | 294/99.2 |

FOREIGN PATENT DOCUMENTS

WO WO 2005074817 A1 * 8/2005 ..... A61B 17/28

* cited by examiner

*Primary Examiner* — Saul Rodriguez
*Assistant Examiner* — Gabriela Puig

(57) ABSTRACT

A tweezer device and method of using that provides an improved gripping tip concept for gripping a work object. The tweezer device comprises two gripping tip bodies arranged in a symmetric vee configuration supported on a first flexible tweezer beam, and a third gripping tip body supported on a second flexible tweezer beam arranged in such a manner that the third gripping tip body engages a work object and directs a force on the work object that is approximately coplanar with the plane of symmetry of the vee configured structure in a manner that pushes the work object into contact with the two vee configured gripping tip bodies thus forming two lines of contact between the work object and the vee configured tip bodies.

8 Claims, 10 Drawing Sheets

TWEEZER DEVICE INCORPORATING IMPROVED GRIPPING TIP STRUCTURES, AND METHOD OF USING

RELATED APPLICATION/CLAIM OF PRIORITY

This application is related to and claims priority from U.S. provisional application Ser. No. 61/663,592, filed Jun. 24, 2012, and entitled Tweezer Device Incorporating Improved Gripping Tip Structures, which provisional application is incorporated by reference herein.

The current invention relates to the design of the gripping tips of tweezer devices, and to a method of using the tweezer with those gripping tip structures.

The most common configuration of tweezers comprises two flexible beams joined together at a proximal end and two opposing gripping tips each of which is located at the distal end of each beam. The gripping tips are the functional ends of the tweezer beams typically used to grip an object, the work object, for manipulation by the tweezer operator. To grip the work object the operator applies finger pressure on each tweezer beam to deflect the beams in a manner that moves the gripping tips closer together to contact and to clamp the work object. The most common tweezer configurations uses tip bodies that incorporate flat gripping surfaces on tip bodies that have a tapered shape to reduce the size of the tip at the functional end to suit the general size of the intended work objects to be gripped. The ends of the tweezer tip bodies can be configured with a range of different sizes to be narrow and sharp for gripping very small work objects at one extreme or configured to be wider and blunt for gripping larger work objects.

FIG. 1 shows an example of a common tweezer configuration with first flexible beam 10, second flexible beam 11, first gripping tip 12, and second gripping tip 13. In this first example of the prior art the tips 12 and 13 have flat gripping surfaces and slightly rounded tip ends. FIG. 2 shows a common variation of the same tweezer type with a serrated surface on each of the flat tip gripping surfaces to increase the amount of gripping contact pressure available. FIG. 3 shows a similar tweezer configuration with flat gripping surfaces and sharp pointed tip bodies. The primary function of a tweezer device is to grip a work object for manipulation by the operator. These common tweezer tip configurations are suitable to grip a wide variety of work object shapes but in many cases the work object is not well constrained by the simple tweezer tip configuration and they primarily rely on the skill and manual dexterity of the operator to secure the work object in the tips and to prevent the work object from inadvertently shifting or dislodging during manipulation.

Other existing tweezer designs incorporate more complex gripping tip bodies that are configured to grip specific shapes of work objects. For example, FIG. 4 shows an example of a common tip configuration designed to securely grip work objects with a circular profile of a specific diameter. FIG. 5 shows a complex tip configuration that uses opposing flat tip bodies of extended area with an effective parallel gripping action. The tip configuration shown in FIG. 5, or variations of it, is commonly used to grip thin flat work objects such as silicon wafers used in semiconductor manufacturing.

DESCRIPTION OF THE INVENTION

The present invention (which is described below in connection with the accompanying drawings) comprises a new and unique tweezer tip structure based on kinematic principles that improves the gripping function of the tweezer device for a variety of work object geometries and dimensions. In addition, the present invention provides a method of gripping a work object, using the gripping function of the tweezer device.

In its preferred form, the present invention provides a tweezer tip structure that comprises two gripping tip bodies arranged in a vee configuration on the tweezer first flexible beam and a third single gripping tip body on the tweezer second flexible beam arranged in such a manner that the third tip body engages the work object and directs a force on the work object in a direction that pushes the work object into contact with the opposing vee configured tweezer tip bodies.

In a method according to the present invention, a tweezer device, having the characteristics set forth above is provided, and a work object is gripped by locating the work object in the symmetric vee on the first flexible tweezer beam, and engaging the work object with the third gripping tip body such that the third gripping tip body pushes the work object into contact with the two vee configured gripping tip bodies thus forming two lines of contact between the work object and the vee configured tip bodies.

Further features of the present invention will become apparent from the following detailed description and the accompanying drawings.

Figure 1:
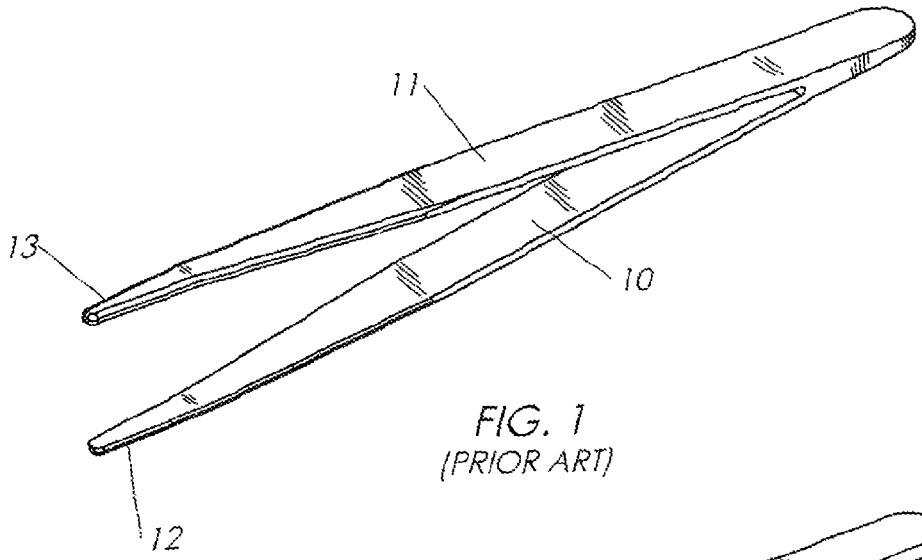
FIG. 1 (PRIOR ART)
FIGS. 1-5 schematically illustrate known tweezer designs, as described herein.
Figure 2:
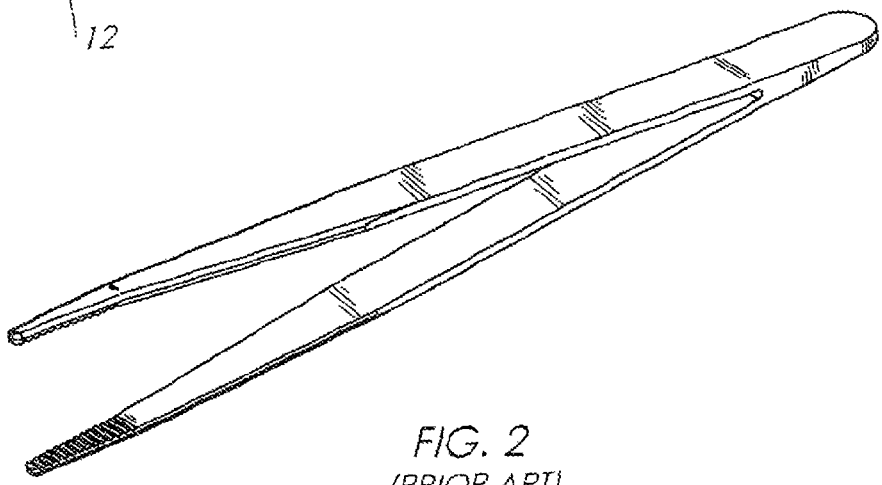
FIG. 2 (PRIOR ART)
Figure 3:
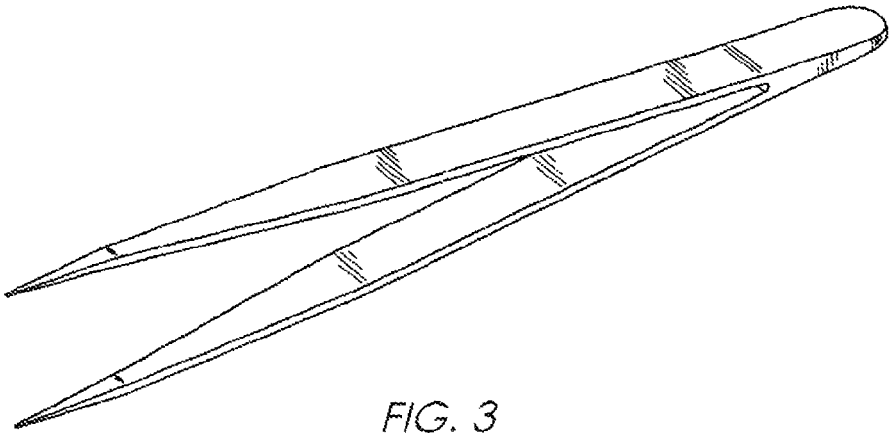
FIG. 3 (PRIOR ART)
Figure 4:
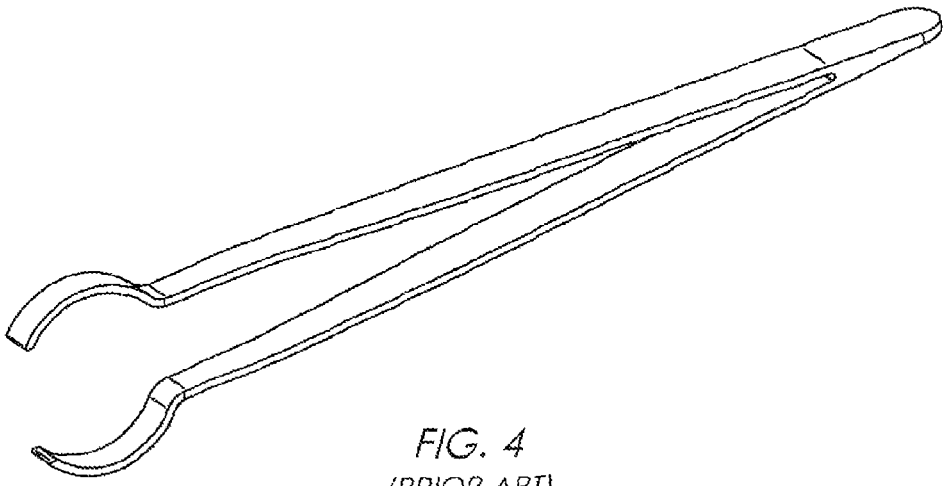
FIG. 4 (PRIOR ART)
Figure 5:
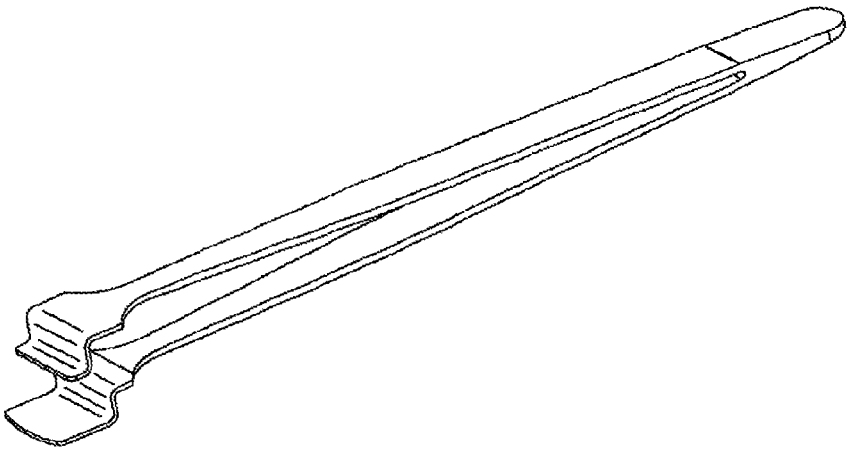
FIG. 5 (PRIOR ART)
Figure 6:
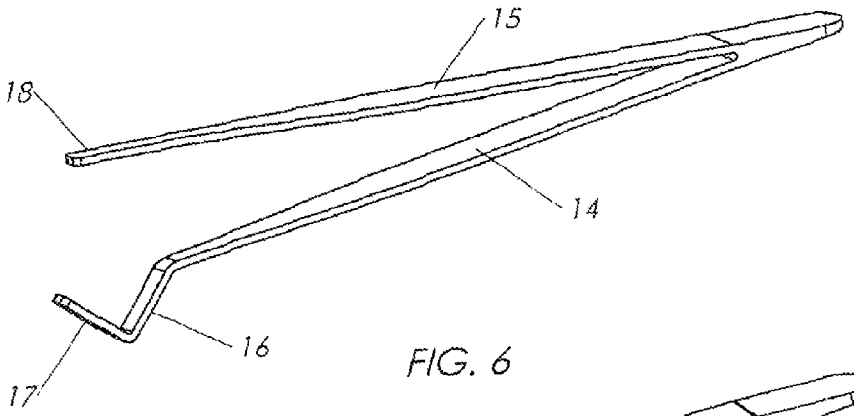
FIGS. 6-10, 11A, B, 12A, B, 13A, B, 14-26, 27A-D 28A-B, 29 and 30 schematically illustrate tweezer configurations, and the method of using those tweezer configurations to grip a work object, according to the present invention, as described herein.

A first embodiment of tweezer according to the present invention is shown in FIG. 6. A first flexible beam 14 and a second flexible beam 15 support the tweezer gripping tips in a conventional manner. The two vee configured tip bodies 16 and 17 are located at the distal end of first beam 14 as shown. A single opposing gripping tip 18 is located at the distal end of second beam 15. In this embodiment, each of the three gripping tip bodies incorporates a flat surface for the gripping face that engages in contact with the work object. In this embodiment the included angle between the two vee tip gripping faces is 90 degrees.

Figure 7:
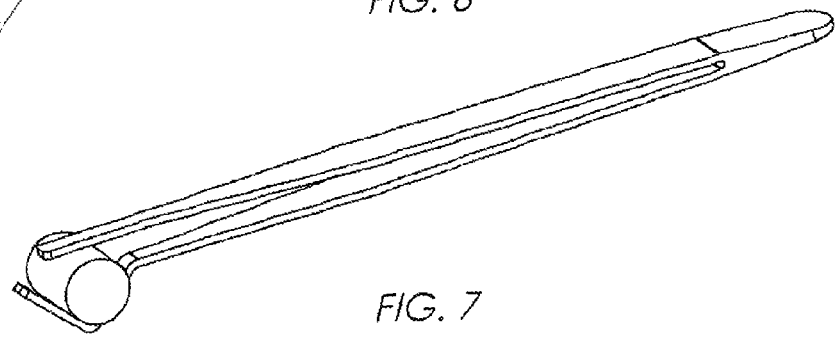
Figure 8:
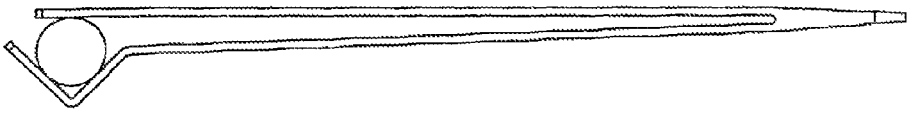
Figure 9:
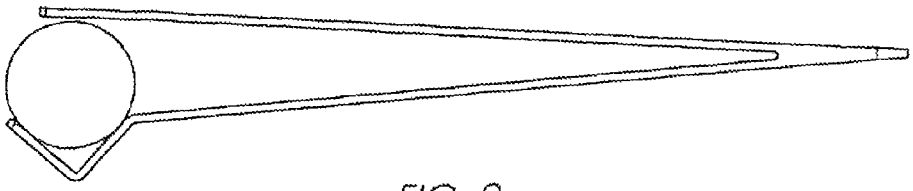

FIGS. 7 and 8 show a cylinder shaped work object gripped by the tweezer tip configuration of the first embodiment, in accordance with the tweezer device and method of the present invention. By nature of the well understood kinematic characteristics of a vee support structure with two flat functional faces, a cylindrical shaped solid object of any size, within the maximum or minimum capacity of the vee, will be constrained when forced into contact with the vee faces as a result of the two lines of contact that are established between the two vee faces and the curved surface of the cylinder. For example, a cylinder will be well constrained by the described tweezer tip geometry except for two degrees of freedom, namely the rotation of the cylinder around its own axis of symmetry and the translation parallel to the line defined by the intersection of the two vee surfaces which we will, call the tweezer vee structure axis. The two not-fully constrained degrees of freedom are partially constrained by the friction forces that result from the surface contact forces of the gripping tips. Gripping of a cylinder work object by clamping the work object in a vee configured structure is a stable support that is independent of the diameter of the cylinder, within the operating size range of the vee structure, and is a significant improvement in the security of gripping the work object compared to common tweezer configurations. FIGS. 8 and 9 show cylindrical objects of two different diameters being gripped by the first embodiment tweezer tip configuration. Many non-circular cylinder shaped objects such as elliptic cylinders and others are equally well constrained by the current invention in the same manner as a circular cylinder.

Figure 10:
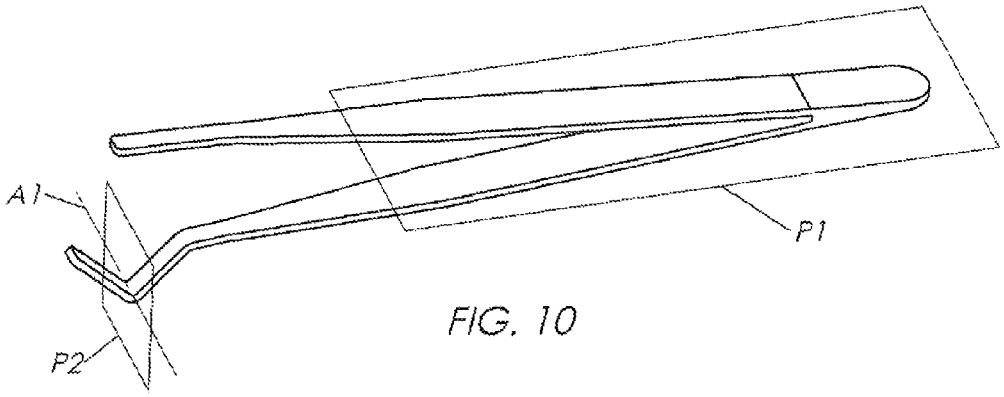
Figure 11A:
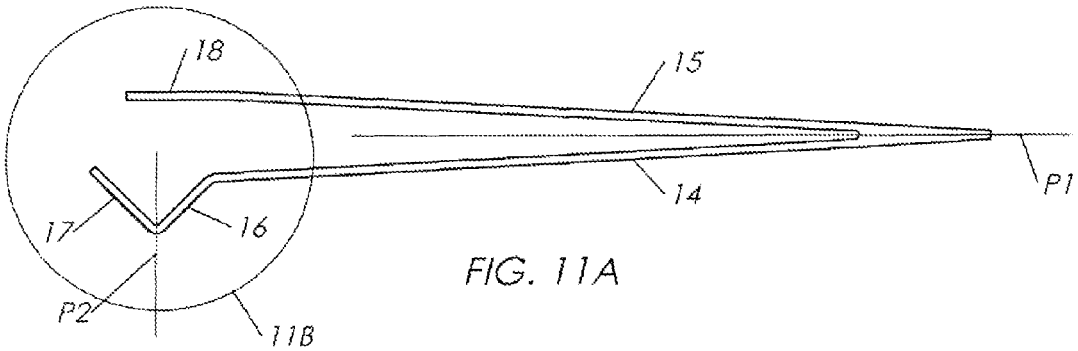
Figure 11B:
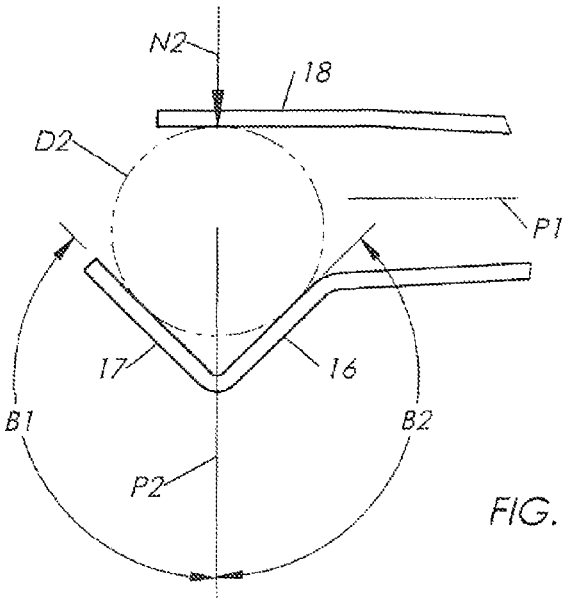

FIGS. 10, 11A and 11B show the tweezer of FIG. 6 with reference planes P1 and P2 and reference axis A1, in accordance with the tweezer device and method of the present invention. Plane P1 is the mid-plane centered between the tweezer first beam 14 and second beam 15. Axis A1 is the vee structure axis defined as the intersection of the flat gripping surfaces of the vee configured tweezer tips 16 and 17. Plane P2 is the mid-plane of the vee configured tips that is coincident with axis A1 and such that angle B1 equals angle B2.

FIG. 11B shows a detail of the tweezer from FIG. 11A with the tweezer flexible beams positioned to clamp a work object with a circular cross section, such as a cylinder shaped object, of diameter D2 which represents an object diameter near the middle of the range of object diameters that can be clamped by the tweezer tips in the manner shown. In this embodiment of the invention the geometry of the tweezer tips 16, 17 and 18 is configured so that the line of contact between tweezer tip 18 and the cylinder work object of diameter D2 is coincident with P2 and the surface normal vector N2 that represents the direction of the clamping force applied by tweezer tip 18 to the cylinder work object is parallel to and coincident with the vee structure mid-plane P2.

Figure 12A:
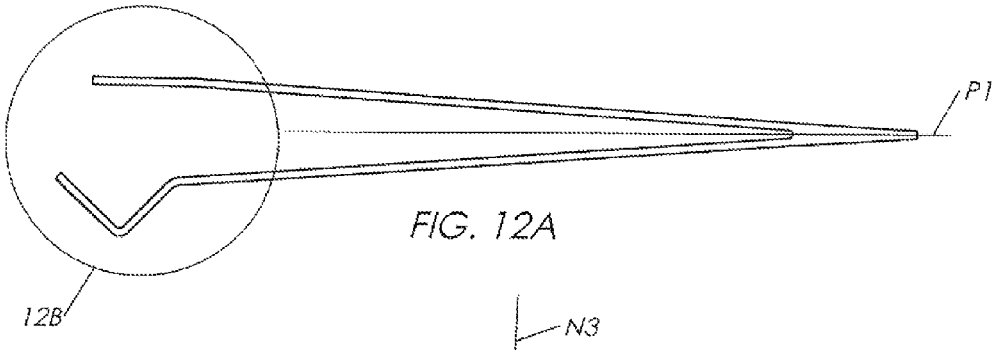
Figure 12B:
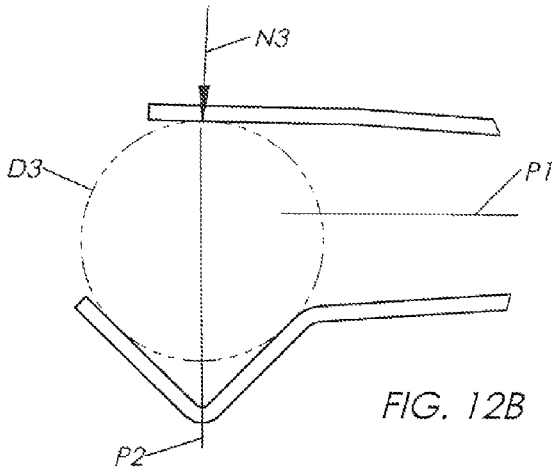
Figure 13A:
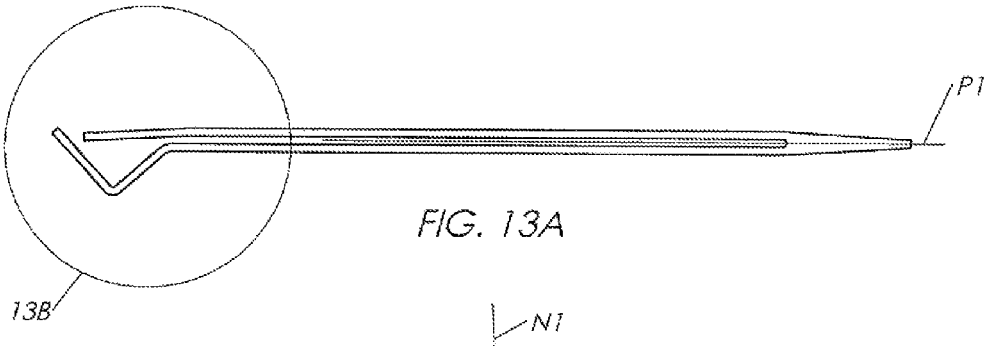
Figure 13B:
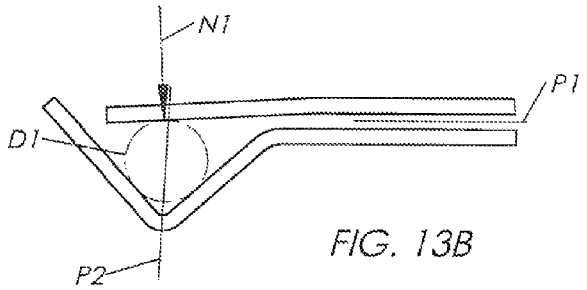

When the flexible tweezer beams, 14 and 15, are deflected to clamp larger or smaller diameters of work objects the geometry of the work object clamping changes due to the rotation of the tweezer tips relative to mid-plane P1 due to the structural deformation of the flexible beams which are effectively cantilevered beams with fixed support at the proximal ends and with large beam deflections at the distal ends. FIGS. 12A and 12B show the tweezer device and method of FIGS. 6-11B with the flexible beams positioned to clamp a cylinder object with circular cross section diameter D3, where D3 is at the maximum diameter clamping capacity of the tweezer vee structure. N3 is the surface normal vector for tip 18 at the line of contact with the work object. N3 is no longer coincident with plane P2 and no longer parallel with P2 but the magnitude of the offset is small and does not affect the clamping function of tweezer tip 18 to force the work object into secure contact with the vee configured tips 16 and 17. FIGS. 13A and 13B show the same tweezer device and method of FIGS. 6-12B with the tweezer beams deflected to clamp a cylinder work object of diameter D1 where D1 is at the minimum diameter clamping capacity of the device. N1 is the surface normal vector for the clamping surface of tip 18 at the line of contact with the work object. In this case N1 is also offset from mid-plane P2 but the offset is small and does not affect the function of the tip 18 to force the work object into contact with the vee configured tips.

It is clear from the FIGS. 10-13B that the clamping geometry of the invention changes for different sized work objects but that the magnitude of the change is small and does not appreciably affect the clamping function of the invention for cylinder shaped work object, in accordance with the tweezer device and method of the present invention.

Figure 14:
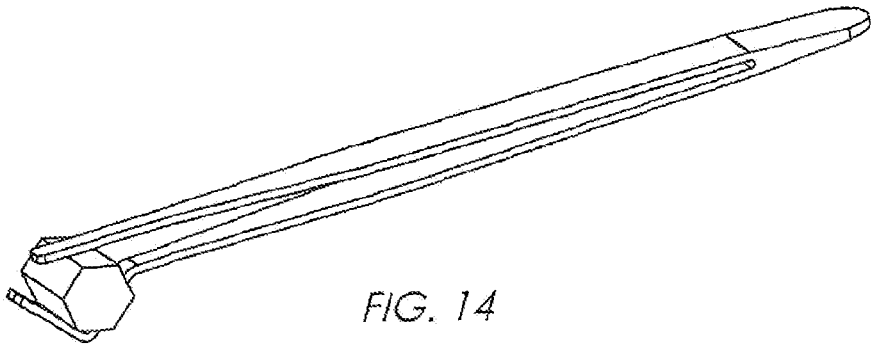
Figure 15:
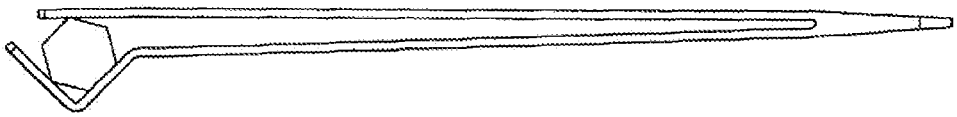
Figure 16:
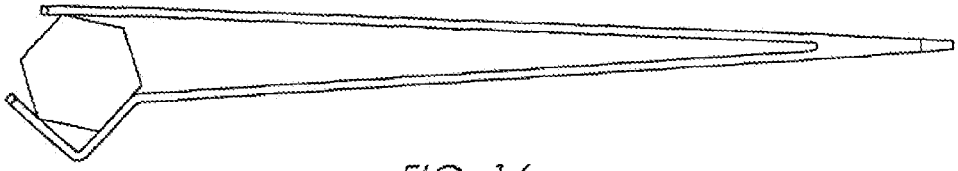
Figure 17:
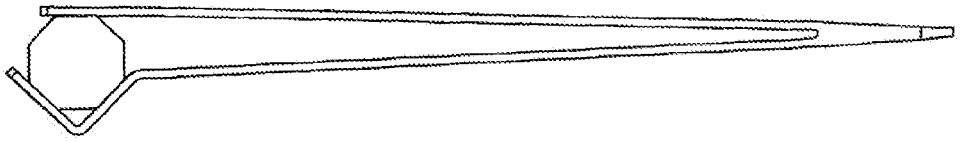

Many shapes of work objects other than cylinders are also well constrained by the tweezer tip structure and method of the present invention. For example, a solid prismoid shaped object of n sides is constrained in five degrees of freedom when gripped by the tweezer device and method of the current invention. FIGS. 14, 15, and 16 show an example of a hexagonal solid prismoid object, where n=6, supported by the first embodiment of the tweezer device and method of the present invention and FIG. 17 shows an example of an octagonal solid prism object, where n=8. In these examples the object is fully constrained in all degrees of freedom except for linear translation parallel to the tweezer vee structure axis. This remaining degree of freedom is partially constrained by the frictional force applied by the gripping surfaces. Work objects with irregular shapes that have the approximate form of cylinders or prismoids are also well constrained by the gripping tips of the tweezer device and method of the present invention due to the kinematic nature of the vee support structure.

Figure 18:
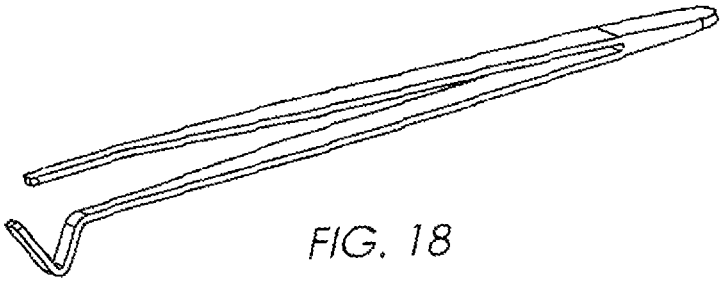
Figure 19:
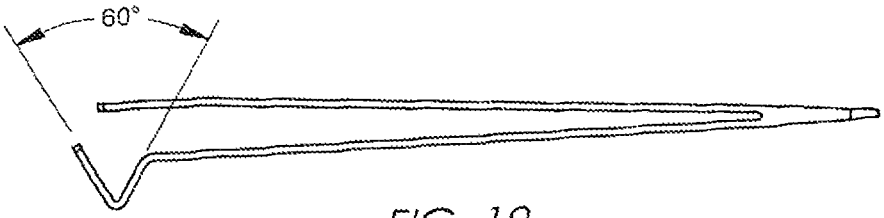
Figure 20:
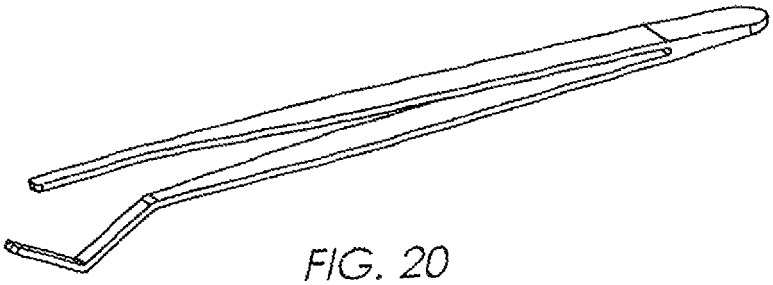
Figure 21:
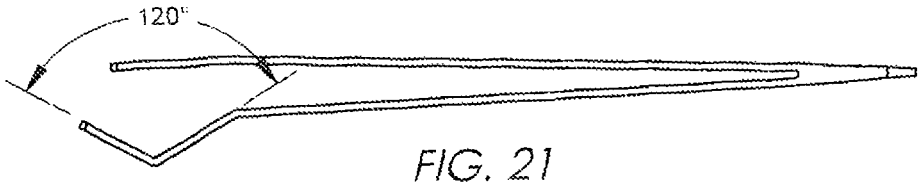

The included angle dimension between the two vee configured tip gripping faces in the tweezer device and method of the present invention is not critical and can vary over a wide range and still function in the manner described to grip various geometries and sizes of objects. For example, FIGS. 18 and 19 show a variation of the first embodiment that uses a 60 degree included angle between the vee tip gripping faces. Another variation is shown in FIGS. 20 and 21 using a 120 degree included angle between the vee tip gripping faces. It is clear, that even over the range of included tip angle dimension shown in these two examples, that the sensible function of the kinematic vee support is maintained regardless of the included tip angle and that the opposing single tipped gripping tip will function to apply a force on the work object that directs the work object into contact with the two vee configured gripping faces. Selection of a particular included, tip angle for the vee structure can be varied to optimize the tweezer device for particular sizes or types of work objects without changing the nature of the current invention.

Figure 22:
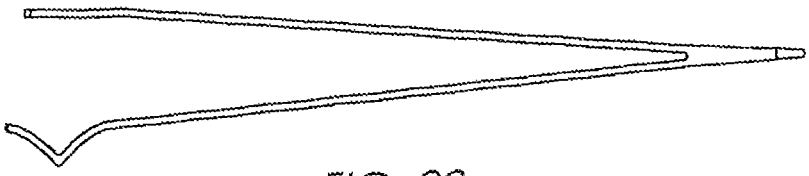

FIG. 22 shows a second embodiment of the tweezer device of the present invention where the vee configured gripping tips have variable radius, non-flat gripping surfaces but maintain the symmetrical geometry of a functional kinematic vee support structure. A convex involute profile is shown in this example but other variable radius shapes are effective as long as the symmetrical vee geometry maintains the function of a kinematic vee support structure for the two gripping tips on the distal end of the first tweezer beam and are opposed by a third gripping tip on the distal end of the second tweezer beam. The convex involute vee configuration provides for an increase in the maximum diameter capacity of the vee structure for cylinder type objects.

Figure 23:
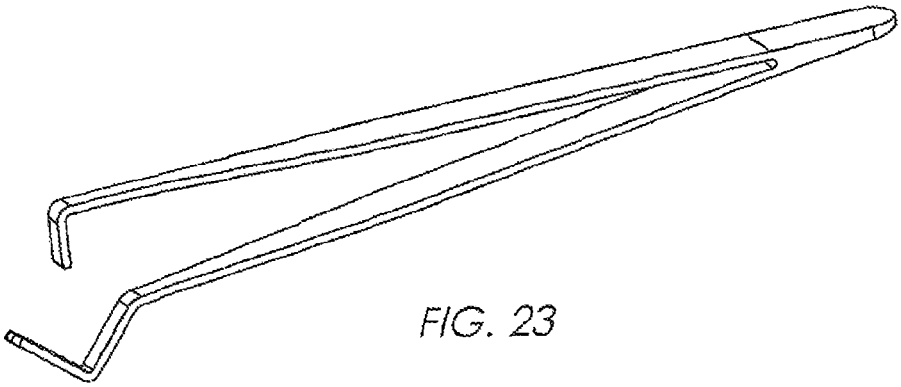
Figure 24:
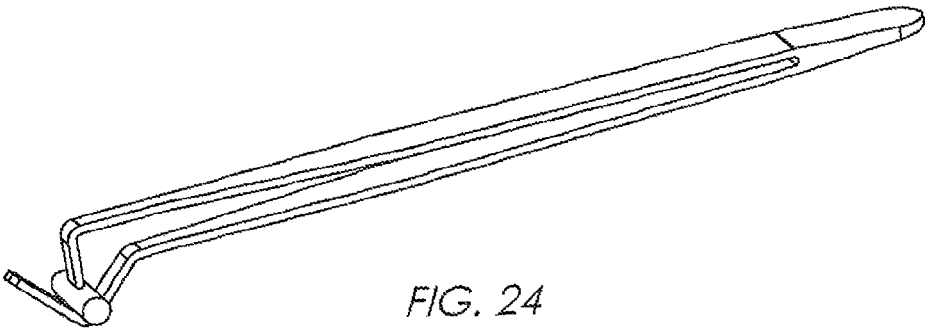
Figure 25:
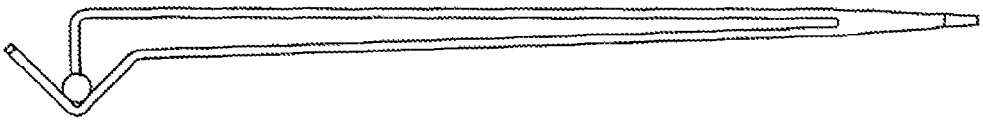
Figure 26:
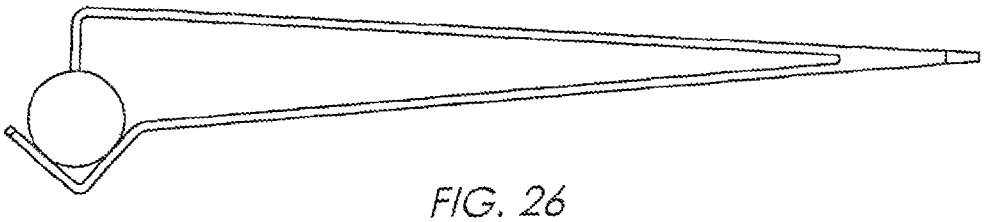

FIG. 23 shows a third embodiment of the tweezer device of the present invention that incorporates a variation in the orientation of the third gripping tip body relative to the second flexible tweezer beam that allows for very small dimensioned objects to be securely gripped in the two opposing vee configured tip bodies while still allowing larger objects to be securely gripped. FIGS. 24 and 25 show this embodiment of the invention gripping a relative small diameter cylinder and FIG. 26 shows it gripping a relative large sized cylinder.

Figure 27A:
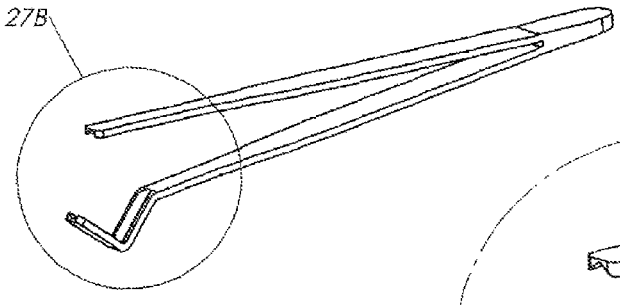
Figure 27B:
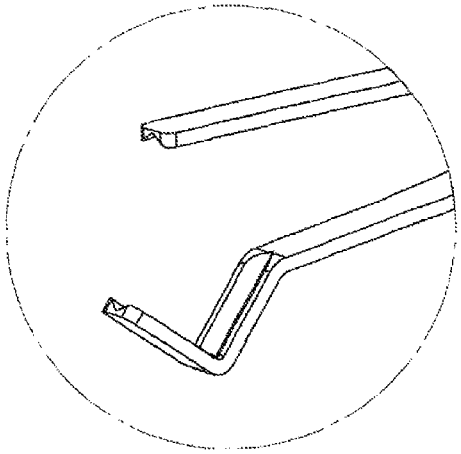
Figure 27C:
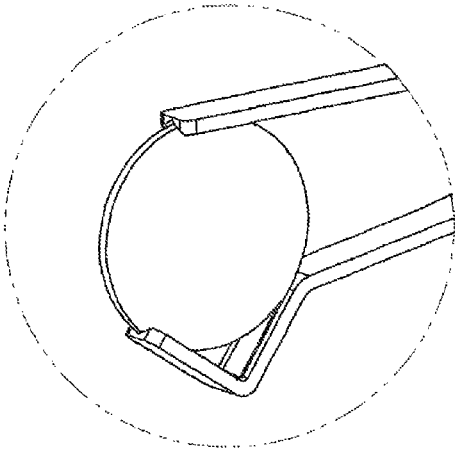
Figure 27D:
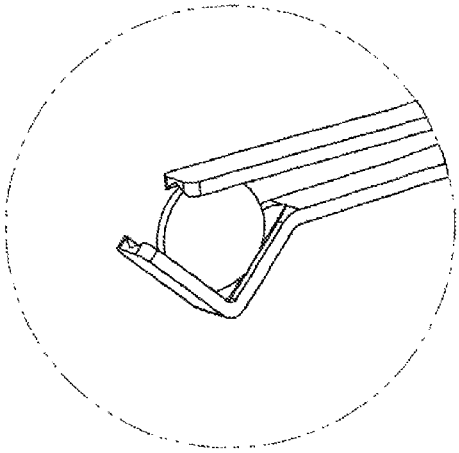

FIGS. 27A-D show a fourth embodiment of a tweezer tip configuration for a tweezer device and method according to the present invention that incorporates an additional feature into the tip configuration of the first embodiment. A longitudinal groove, with an elective vee cross sectional shape, is centrally located on each of the three tweezer tip gripping faces. This additional groove feature is configured to allow the secure gripping of thin disk, or coin shaped, work objects as shown in FIG. 27C (relative large diameter work object) and FIG. 27D (relative small diameter work object). The gripping functions described for the first embodiment of tweezer tips is not impaired by this additional longitudinal groove feature since the original functional gripping surfaces on each of the three tweezer tip structures is maintained on either side of each longitudinal groove. This embodiment of the tweezer device and method of the present invention will securely grip a large variety of work object shapes.

Figure 28A:
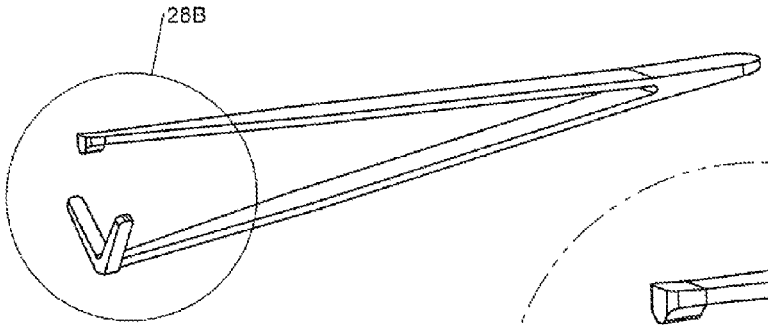
Figure 28B:
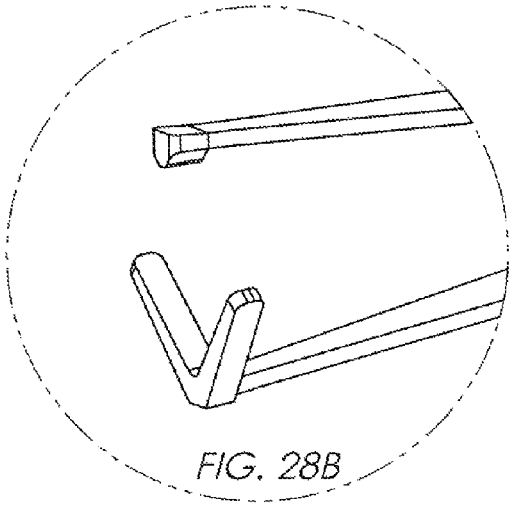
Figure 29:
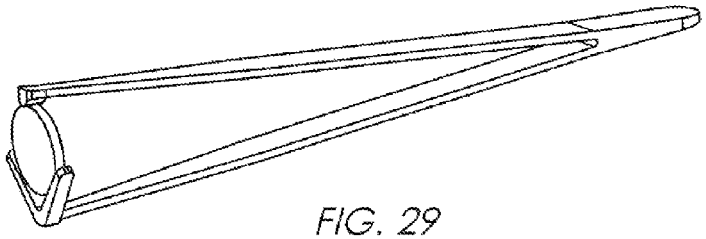
Figure 30:
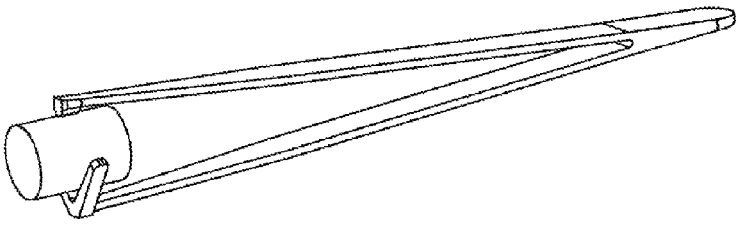

FIGS. 28A,B, 29, and 30 show a fifth embodiment of the tweezer device and method of the present invention where the orientation of the two vee structure gripping tip bodies is revised such that the vee structure axis is parallel to the longitudinal axis or long dimension of the tweezer beam that supports it instead of perpendicular to the tweezer beam as in the previous embodiments. FIGS. 29 and 30 show this embodiment gripping a disk shaped work object and a cylinder work object respectively, in accordance with the present invention. This embodiment of the tweezer tip configuration demonstrates that the functionality of the present invention is not dependent on a single orientation of the vee structure axis relative to the first flexible tweezer beam but is only dependent on the gripping action of the two vee structured tip bodies combined with the action of the opposing third tip body that forces the work object into contact with the vee structure. The gripping tips of the tweezer embodiment shown in FIGS. 28A-30 could also incorporate the central groove feature on each gripping face as described for the previous embodiment and shown in FIGS. 27A-27D.

With the foregoing disclosure in mind, it is believed that various adaptations of a tweezer and a method of using the tweezer, with a new paradigm in the manner in which the tweezer grips a work object, according to the principles of the present invention, will be apparent to those in the art.

The invention claimed is:

1. A tweezer device with an improved gripping tip structure that comprises two gripping tip bodies arranged in a symmetric vee configuration supported on a first flexible tweezer beam and a third gripping tip body supported on a second flexible tweezer beam arranged in such a manner that the third gripping tip body is oriented to engage a work object and direct a force on the work object that is approximately coplanar with the plane of symmetry of the vee configured structure in a manner that pushes the work object into contact with the two vee configured gripping tip bodies thus forming two lines of contact between the work object and the vee configured tip bodies, where each of the three gripping tip bodies has a vee-groove profile central to each of the three gripping tip bodies creating a gripping geometry designed to securely grip thin circular disks.

2. The tweezer device of claim 1 where the two gripping tip bodies arranged in a vee configuration on a first flexible tweezer beam have flat gripping faces with an included angle between them of 90 degrees.

3. The tweezer device of claim 1 where the two gripping tip bodies arranged in a vee configuration on a first flexible tweezer beam have flat gripping faces with an included angle between them of a value less than or more than 90 degrees such that the function of a kinematic vee support is preserved.

4. The tweezer device of claim 1 where the two gripping tip bodies arranged in a symmetrical vee configuration on a first flexible tweezer beam have non-flat gripping surfaces, including an involute vee profile or other variable radius profile.

5. A method of gripping a work object, comprising a. providing a tweezer device with a gripping tip structure that comprises two gripping tip bodies arranged in a symmetric vee configuration supported on a first flexible tweezer beam and a third gripping tip body supported on a second flexible tweezer beam arranged in such a manner that the third gripping tip body engages a work object and directs a force on the work object that is approximately coplanar with the plane of symmetry of the vee configured structure in a manner that pushes the work object into contact with the two vee configured gripping tip bodies thus forming two lines of contact between the work object and the vee configured tip bodies, and b. gripping a work object by locating the work object in the symmetric vee on the first flexible tweezer beam, and engaging the work object with the third gripping tip body such that the third gripping tip body pushes the work object into contact with the two vee configured gripping tip bodies thus forming two lines of contact between the work object and the vee configured tip bodies;

wherein providing the tweezer device comprises providing each of the three gripping tip bodies with a vee-groove central to each of the three gripping tip bodies, creating a gripping geometry that securely grips a work object with the profile of a thin circular disk, and gripping a work object with the profile of a thin circular disk.

6. The method of claim 5 where providing the tweezer device comprises providing the two gripping tip bodies arranged in a vee configuration on the first flexible tweezer beam with flat gripping faces with an included angle between them of 90 degrees.

7. The method of claim 5 where providing the tweezer device comprises providing the two gripping tip bodies arranged in a vee configuration on a first flexible tweezer beam with flat gripping faces with an included angle between them of a value less than or more than 90 degrees such that the function of a kinematic vee support is preserved.

8. The method of claim 5 where providing the tweezer device comprises providing the two gripping tip bodies arranged in a symmetrical vee configuration on a first flexible tweezer beam with non-flat gripping surfaces including an involute vee profile or other variable radius profile.

* * * * *